United States Patent [19]

Fenchel

[11] Patent Number: 5,060,627

[45] Date of Patent: Oct. 29, 1991

[54] DEVICE AND METHOD FOR FINE TUNING A COMPOUND ARCHERY BOW

[75] Inventor: Jack L. Fenchel, Beaver Falls, Pa.

[73] Assignee: Jo Jan Sportsequip Co., Washington, Pa.

[21] Appl. No.: 527,273

[22] Filed: May 23, 1990

[51] Int. Cl.[5] ..... F41B 5/14

[52] U.S. Cl. ..... 124/88; 124/90; 124/24.1; 124/25.6

[58] Field of Search ..... 124/91, 90, 88, 86, 124/23.1, 24.1, 25.6, 87

[56] References Cited

U.S. PATENT DOCUMENTS

| | | | |
|---|---|---|---|
| 3,618,586 | 11/1971 | Current | 124/24.1 X |
| 3,750,641 | 8/1973 | Ramsey | 124/91 X |
| 3,866,592 | 2/1975 | Carella | 124/88 |
| 4,552,121 | 11/1985 | Treaster | 124/90 X |
| 4,596,229 | 6/1986 | Bell | 124/88 X |
| 4,848,306 | 7/1989 | Treaster | 124/24.1 |
| 4,911,137 | 3/1990 | Troncoso | 124/88 X |

*Primary Examiner*—Peter M. Cuomo

*Attorney, Agent, or Firm*—Armstrong, Nikaido, Marmelstein, Kubovcik & Murray

[57] ABSTRACT

A device and method for fine tuning a compound archery bow. The device has an elongated support plate secureable to the bow handle with pivotally attached front and rear arms. The rear arm carries an indicator pin while the front arm carries a tensioning element for a line or a pair of lines that extend from in front of the bow handle to the bow string and maintains the lines taut when the bow string is at rest and, also when fully drawn. The indicator pin is positioned relative to the lines while the lines are taut with the bow string at rest and, the position determined when the bow string is fully drawn to establish the tuning of the bow.

8 Claims, 3 Drawing Sheets

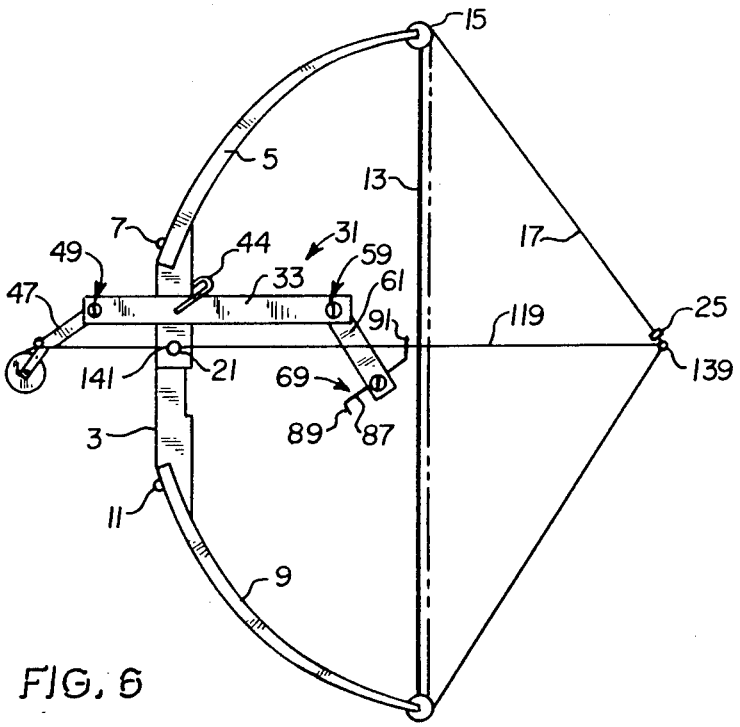
FIG. 6
FIG. 7A
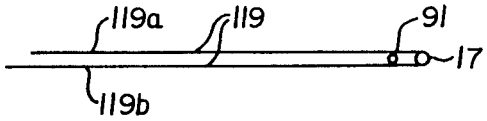
FIG. 7B
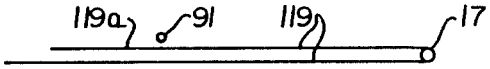
FIG. 7C
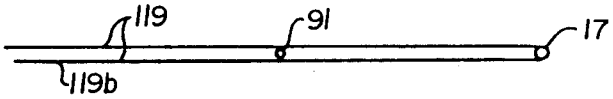
FIG. 8A
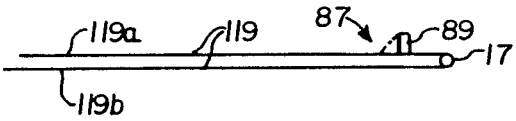
FIG. 8B
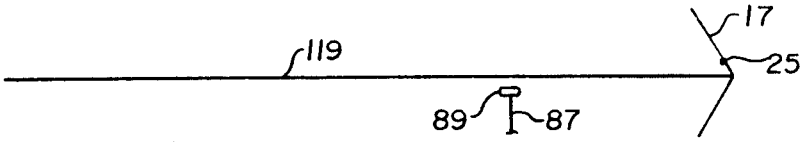
FIG. 8C
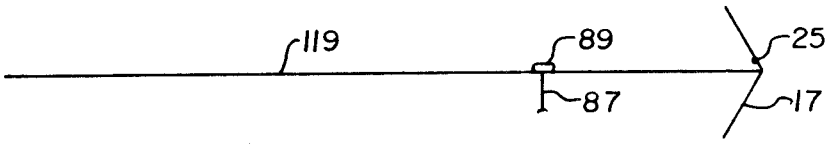

DEVICE AND METHOD FOR FINE TUNING A COMPOUND ARCHERY BOW

FIELD OF THE INVENTION

The present invention relates to a device and method for the fine tuning of a compound archery bow for precise location of the arrow rest to provide accurate horizontal flight of an arrow and for precise adjustment of the limbs of the bow to provide accurate vertical flight of an arrow.

BACKGROUND OF THE INVENTION

Compound archery bows are used extensively in the sports of hunting and target shooting. While such bows are initially rough adjusted by the manufacture, it is incumbent upon the ultimate user to precision adjust the bow so as to provide accuracy for the arrow flight. Also, even where a bow may have been previously fine tuned and was shooting accurately, after storage or non-use for a period of time, the bow must be again fine tuned so as to compensate for thermal or other stresses to which the bow has been subjected.

Usually, the method for adjusting the bow for accuracy has involved the shooting of a number of arrows with various adjustments made until the user is satisfied that the bow is in tune. This trial and error method, in addition to consuming an inordinate amount of time and effort, does not do as good a job of accurate tuning as is desired.

A previous bow tuning aid is illustrated in U.S. Pat. No. 4,596,229 and comprises a mechanical device that is attached to the bow handle and extends rearwardly towards the bow string, and has a slideable block mounted on an extension bar with the block carrying a locator rod. The locator rod has a button thereon, which is placed immediately behind the arrow nock of an arrow held at draw position on the bow. After relaxing the bow string, the user sights along the arrow to determine the position of the button in relation to the arrow axis to see whether the nock end of the arrow moves up, down, left, or right when the bow is drawn. That bow tuning aid, however, requires securement of the bow in a holding rack to hold the bow in drawn position, so that the bottom of the locator rod can be correctly positioned, and visual sighting along an arrow shaft axis in order to determine what adjustments are needed to the bow.

It is an object of the present invention to provide a compact bow adjustment device that can be easily attached to a bow and quickly give an accurate reading of the bow accuracy.

It is another object of the present invention to provide a quick and easy method for accurately fine tuning a compound bow.

SUMMARY OF THE INVENTION

A bow adjustment device for adjustment of compound archery bows has an elongated support plate, with pivotally attached front and rear arms. The device may be secured to the sight bracket and is secured to the bow handle such that at least one line and preferably a pair of spaced lines carried by the front arm extend from in front of the bow handle to the string and are held under tension both when the bow string is at rest and when drawn. An indicator is attached to the rear arm and positioned between the handle and the bow string when the string is at rest.

The indicator is preferably a releasably secured indicator pin on a releasably secured rod that is attached to the rear arm of the device, and the indicator pin preferably has a horizontally extending section at one end and a vertically extending section at the other end, and is rotatable to position either section relative to the line or pair of spaced lines. The tensioning device is preferably a tensioning reel that is attached to a support rod, releasably secured to the front arm, with the line or spaced lines passing over a rotatable spool on the support rod.

The present device is useful both for determining precise placement of a cushion pin and arrow rest to obtain accurate horizontal flight of an arrow, and for determining needed adjustments to the bow limbs, wheels and cables to obtain accurate vertical flight of the arrow.

In the method of adjusting the bow for accurate horizontal flight of an arrow, a line, and preferably a pair of spaced lines is provided which are attached to the bow string below the nock point and extend beyond the handle of the bow, just above the cushion plunger aperture, and are held taut while the string is at rest or drawn. An indicator is positioned adjacent the line or between the pair of lines adjacent the bow string when the string is at rest. The bow string is then drawn and the relationship of the indicator to the line or spaced lines determined. When the indicator remains adjacent the line or between the spaced lines, both when the bow string is at rest and when fully drawn, the cushion plunger and arrow rest are secured to the handle.

In the method of adjusting the bow for accurate vertical flight of an arrow, a line or a pair of lines are provided and attached to the bow string while holding the lines taunt both when the bow string is at rest and when drawn. An indicator is placed horizontally flush with the line or lines, adjacent the bow string, with the bow string at rest. After drawing the bow string, the location of the indicator is determined relative to the line or lines and when the indicator remains horizontally flush with the line or lines when the bow string is at rest and when drawn, the limbs and cables are set for accurate vertical flight of an arrow released from the bow.

BRIEF DESCRIPTION OF THE DRAWINGS

FIG. 6 is a side elevational view of the bow adjustment device secured to a bow, with the vertical extension of an indicator pin placed for adjusting the bow for accurate horizontal flight of an arrow;

FIG. 7A shows the placement of the vertical extension of the indicator pin with the bow string at rest;

FIG. 7B shows the location of the vertical extension if the indicator pin with the bow string drawn and the string off-set relative the position required for accurate shooting;

FIG. 7C shows correct location of the vertical extension of the indicator pin with the bow string drawn when the bow is accurate;

FIG. 8A is a plan view of the correct placement of the horizontal extension of the indicator pin with the bow string at rest;

FIG. 8B is a side elevational view of the location of the horizontal extension of the indicator pin with the bow string drawn and the string "riding up";

FIG. 8C is a side elevational view of the location of the horizontal extension of the indicator pin with the bow correctly adjusted for accurate vertical flight of an arrow.

DETAILED DESCRIPTION

Figure 1:
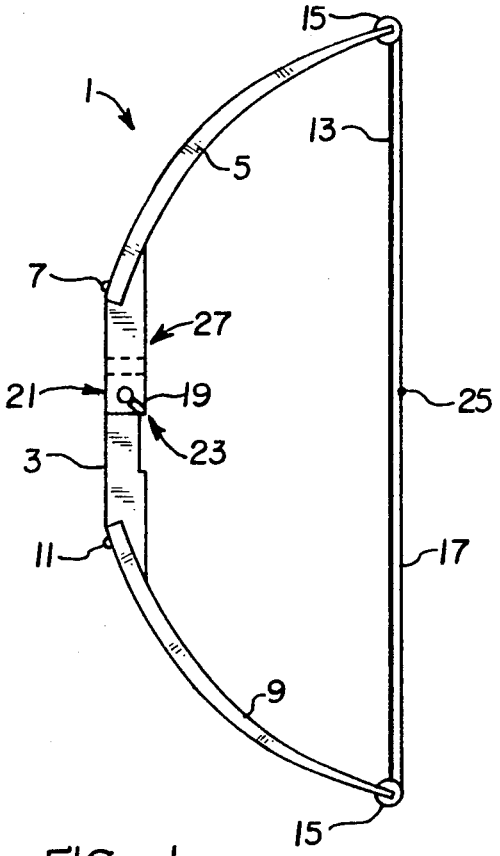
FIG. 1 is a side elevational view of a compound bow for which the bow adjustment device of the present invention is usable.

FIG. 1 illustrates a compound archery bow for which the bow adjustment device of the present invention is used. The bow, as is conventional, comprises a handle 3 having an upper limb 5 attached thereto by upper limb bolt 7 and lower limb 9 attached thereto by lower limb bolt 11. The bow has cables 13 which cooperate with cams 15, and a bow string 17, which extends between the outer ends of the upper and lower limbs 5 and 7. A cushion plunger 19 is situated in a cushion plunger aperture 21 in the handle 3 adjacent an arrow rest 23, while a nock point 25 is provided on the bow string 17. A dovetail sight bracket 27 may be provided on the handle 3 on the side opposite cushion plunger 19 for securement of a bow sight (not shown). The bow itself, which may be one of numerous types and designs and which may have numerous auxiliary components, does not form a part of the invention itself, but is commercially available.

Figure 2:
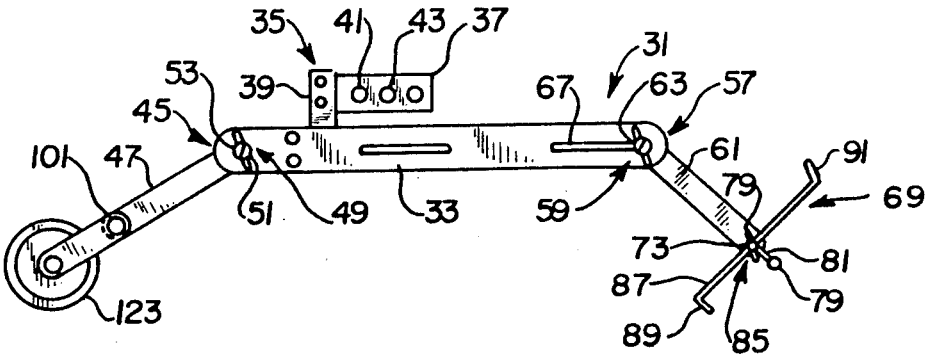
FIG. 2 is a side elevational view of the bow adjustment device of the present invention.
Figure 3:
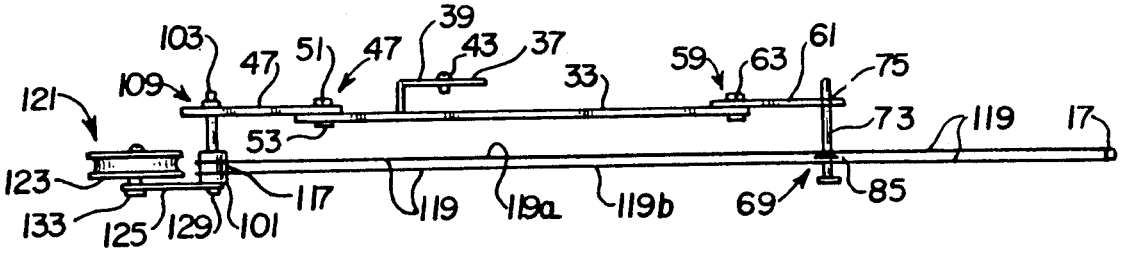
FIG. 3 is a top plan view of the bow adjustment device with the pair of lines attached to the bow string when drawn.

Referring now to FIGS. 2 and 3, the bow adjustment device 31 is illustrated, which device comprises an elongated support plate 33, and means 35 for securing the support plate 33 to the handle 3 of a bow, such as a dovetail element 37 that will mate with a dovetail sight bracket 27 on the handle 3. The dovetail element 37 is illustrated as attached to the support plate 33 by means of a leg 39, the dovetail element 37 having a plurality of threaded openings 41 therein, and a securing means such as a threaded screw 43 to attach the support plate 33 to a bow handle 3 adjacent the arrow rest 23, as hereinafter described. In those instances where the bow does not have a sight bracket, the means 35 for securing the support plate to the handle may be a C-clamp 44, as illustrated in FIG. 6, or other securement device. Attached to the support plate 33, adjacent a first end 45 is a front arm 47, by a pivotal attachment 49, shown as a wing nut 51, that threadedly engages with a bolt 53 that passes through a hole 55 in the support plate 33. Adjacent the second end 57 of the support plate 33, there is attached, by a pivotal attachment 59, a rear arm 61. The pivotal attachment 59, as illustrated, may comprise a wing nut 63 threadedly engaged with a bolt 65 on the second arm 61 that passes through a slot 67 in the support plate 33.

Figure 4:
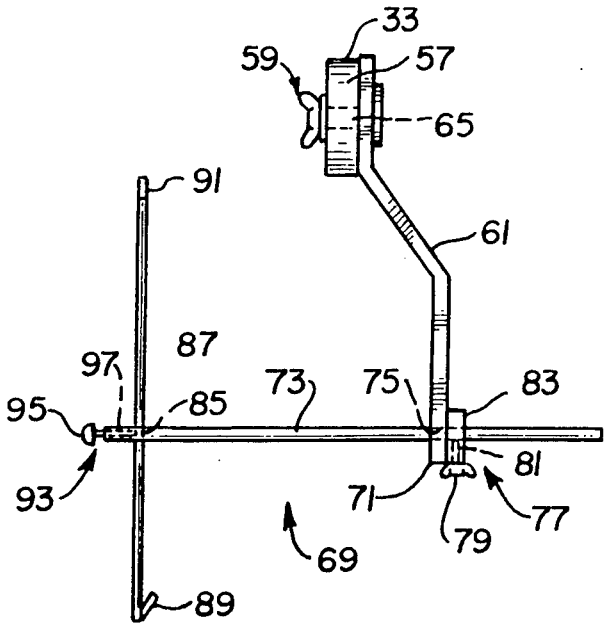
FIG. 4 is a rear view of the bow adjustment device showing the indicator.

An indicator 69 is attached to the rear arm 61 at a location adjacent the end 71 thereof which is distant from the support plate 33, the indicator 69 being both horizontally and vertically moveable relative to the rear arm 61. The indicator 69 illustrated in FIG. 4, is comprised of a rod 73 that passes through bore 75 in the rear arm 61, with a releasable securement means 77, such as a wing bolt 79, passing through threaded bore 81 of a lock washer 83, being used to contact and secure the rod 73 relative to the rear arm and provide for loosening of the rod 73 for horizontal sliding of the rod in the bore 75. Passing through an opening 85 in the rod 73 is an indicator pin 87 having a horizontally extending section 89 and a vertically extending section 91 on opposite ends thereof. The pin 87 is slideable in the opening 85 of the rod 73 and securable at various locations therealong by a releasable securement means 93, illustrated as a wing bolt 95 located in a threaded bore 97 in the rod 73.

Figure 5:
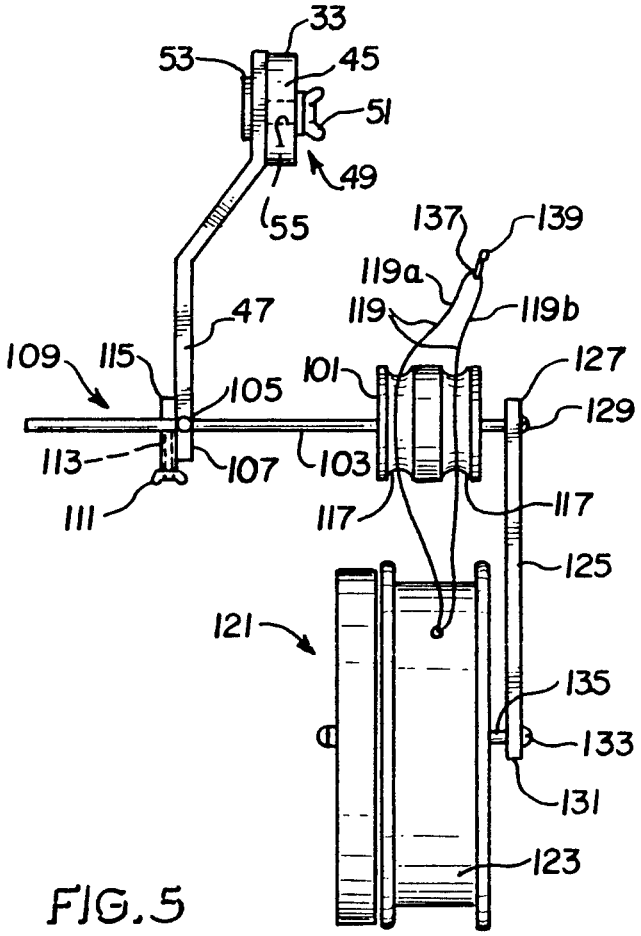
FIG. 5 is a front view of the bow adjustment device showing the spaced lines and tensioning means for the lines.

A rotatable spool 101 (FIG. 5) is disposed adjacent to the front arm 47 by means of a support rod 103 which passes through a bore 105 in the front arm adjacent the distal end 107 thereof spaced from the support plate 33. A releasable securement means 109 for the support rod 103 is illustrated as a wing bolt 111 passing through a threaded bore 113 of a lock washer 115, to secure the support rod 103 relative to the front arm 47 and provide for loosening of the support rod 103 for horizontal sliding movement in the bore 105. Rotatably disposed over the support rod 103, the spool 101 has at least one groove 117 that carries a line 119, and preferably a pair of spaced grooves 117 which carries at least one line 119 that is extendable to the bow string and moveable therewith. The present bow adjustment device 31 has at least one line 119, and may be used with only one line 119. However, the preferred embodiment uses spaced lines **119*a* and 119*b*, and the following description of the device and its operation will be described hereinafter in relation to the preferred embodiment. The lines 119*a* and 119*b* are spaced apart a distance that corresponds to the diameter of the arrow that is to be shot from the bow, generally between about one-quarter to about three-eighths of an inch apart, and typically about twenty-one sixty-fourths of an inch apart. A tensioning means 121 for the lines is illustrated in FIG. 5 as a spring biased tensioning reel 123 which is suspended from support rod 103 by means of a link bar 125. Link bar 125 is secured at one end 127 to the support rod 103, such as by screw bolt 129 and to the tensioning reel at the other end 131 such as by screw bolt 133. The tensioning reel 121 is rotatably mounted on a shaft 135**.

The bow adjustment device 31 of the present invention is useful for both precise placement of the arrow rest 34 and fine tuning of the archery bow 1.

After consulting the compound bow owner's manual to make preliminary adjustments such as bow string draw length and bow string draw weight, a conventional bow square would be attached to the bow string to determine the placement of the nock point 25 on the bow string. The nock point 25 is usually clamped about ⅜" above the bottom of the cushion plunger aperture 21 after the preliminary adjustments have been made.

For precise location of the arrow rest 23, to precision tune the horizontal flight of an arrow released from the bow (no right or left flight deviation), the bow adjustment device 31 is attached to the handle 3 of the bow 1 by sliding the dovetail element 37 into the sight bracket 27 and tightening the threaded screw 43 against the bow handle 3 to fix the bow adjustment device 31 securely thereto. The pair of spaced lines 119 which may be connected at their outer ends 137 and a clip 139 provided thereat, is pulled from the tensioning means 121 and clipped to the bow string 17 just below the nock point 25. The pivotal attachment 49 of the front arm 47 is then loosened, and the arm 47 is positioned vertically to a location such that the pair of lines 119 will pass the bow handle 3 at the top edge 141 of the cushion plunger aperture 21, with the bow string 17 at rest (indicated in dash line of FIG. 6). The pivotal attachment 59 of the rear arm 61 is loosened and the rear arm 61 positioned both horizontally and vertically, such that the indicator 69 is positioned at a location where the vertically extending section 91 of the indicator pin 87 is placed to extend upwardly between the pair of spaced lines 119, in front of the bow string 17, with the bow string at rest (FIG. 7A). The bow string 17 is then fully drawn (FIG. 6) and the location of the vertically extending section 91 of the indicator pin observed relative to the pair of lines 119. The vertically extending section 91 will remain between the lines 119 if the bow is accurately adjusted. If the pair of lines 119 have moved either to the right or the left (FIG. 7B), and the vertically extending section 91 of the indicator pin is not between the lines 119, the support rod 103 is released from securement in the front arm 47 and moved either left or right (inwardly or outwardly in the bore 105). The placement of the vertically extending section 91 of indicator pin 87 is then repeated and the bow string 17 fully drawn again. When the vertically extending section 91 of the pin 87 remains between the lines 119, both when the bow string is at rest and when fully drawn (FIG. 7C), the cushion plunger with a converted shelf rest is screwed into the bow handle and aligned such that the cushion tip contacts the line 119 closest thereto and then turned back one turn and locked in place. The shelf rest is then attached flush with the bottom of the cushion plunger aperture 21. If a prong rest is to be used, each of the prongs are mounted on the handle 3, one of each directly under a respective spaced line 119 and flush with the bottom of the cushion plunger aperture 21.

The bow adjustment device 31 of the present invention is also useful in fine tuning of the bow to precisely adjust the upper and lower limbs 5 and 9 to insure accurate vertical flight of an arrow.

For limb adjustment, the indicator pin 87 is moved such that the horizontally extending section 89 is positioned horizontally adjacent to the confronting nearest line of the pair of lines 119, with the bow string 17 at rest position (FIG. 8A). This movement is effected by loosening the releasable securement means 77 and rotating rod 73, while also sliding the rod 73 in the bore 75 of rear arm 61 The rod 73 is then secured tightly to provide the correct positioning of the horizontally extending section 89. With the horizontally extending section 89 of indicator pin 87 flush with the adjacent line of the pair of lines 119, the bow string 17 is fully drawn. If the pair of lines 119 rise above the horizontally extending section 89 of the indicator pin 87 (FIG. 8B), this shows that the bow string is running up, i.e., the flight of an arrow released from the bow will be directed downwardly. After slowly bringing the bow string 17 back to rest position, the user would loosen the top limb bolt 7 (about one-half turn) and tighten the bottom limb bolt 11 (about one-half turn). The horizontally extending section 89 of the indicator pin 87 is then repositioned flush with the adjacent line of the pair of lines 119, and the full drawing of the bow string 17 repeated. If the bow string 17 is still riding up, the user would adjust the bottom cable or cam 15 by turning the top yoke idler wheel to the next longer draw position. If the pair of lines 119 run below the horizontally extending section 89 of the indicator pin 87, the reverse action is taken, the lower limb bolt 11 being tightened while the upper limb bolt 7 is loosened. When the bow string 17 retains its relative location with the lines 119 both at rest and at full draw of the bow string (FIG. 8C), the limbs are accurately adjusted and precise vertical flight of an arrow released from the blow string 17 is assured.

What is claimed is:

1. A bow adjustment device attachable to a compound archery bow having a handle, limbs and a string, for fine tuning of the same comprising:

an elongated support plate;

means for securing the elongate support plate to the handle of the bow adjacent the location of an arrow rest with a first end thereof spaced from a front of the handle of said bow and a second end thereof positioned between the handle and the bow string;

a front arm pivotally attached to said support plate adjacent the first end thereof;

a rear arm pivotally attached to said support plate adjacent the second end thereof;

at least one line carried by the front arm, extendable to the bow string and moveable therewith;

an indicator comprising a rod releasably secured to said rear arm and an indicator pin releasably secured to said rod, attached to the rear arm; and means for tensioning said at least one line, to maintain the same taut when the bow string is at rest and when fully drawn.

2. A bow adjustment device as defined in claim 1, wherein said at least one line comprises a pair of spaced lines.

3. A bow adjustment device as defined in claim 1, wherein said means for securing the elongated support plate to the handle comprises a dovetail element mateable with a sight bracket carried by the bow handle.

4. A bow adjustment device as defined in claim 1, wherein said indicator pin is releasably secured in an opening through said rod, and the pin has a horizontally extending section at one end and a vertically extending section at the other end thereof.

5. A bow adjustment device attachable to a compound archery bow having a handle, limbs and a string, for fine tuning of the same comprising:

an elongated support plate;

means for securing the elongated support plate to the handle of the bow adjacent the location of an arrow rest with a first end thereof spaced from a front of the handle of said bow and a second end thereof positioned between the handle and the bow string;

a front arm pivotally attached to said support plate adjacent the first end thereof;

a rear arm pivotally attached to said support plate adjacent the second end thereof;

a pair of spaced lines carried by the front arm, extendable to the bow string and moveable therewith;

an indicator comprising a rod releasably secured to said rear arm and an indicator pin releasably secured to said rod, said pin having a horizontally extending section at one end and a vertically extending section at the other end thereof;

a support rod releasably secured to said front arm; and a rotatable spool mounted on said support rod to which said pair of spaced lines are attached, to maintain the lines taut when the bow string is at rest and when fully drawn.

6. A bow adjustment device attachable to a compound archery bow having a handle, limbs and a string, for fine tuning of the same comprising:

an elongated support plate;

means for securing the elongated support plate to the handle of the bow adjacent the location of an arrow rest with a first end thereof spaced from a front of the handle of said bow and a second end thereof positioned between the handle and the bow string;

a front arm pivotally attached to said support plate adjacent the first end thereof;

a rear arm pivotally attached to said support plate adjacent the second end thereof;

at least one line carried by the front arm, extendable to the bow string and moveable therewith;

an indicator attached to the rear arm; and means for tensioning said at least one line, comprising a support rod releasably secured to said front arm, a rotatable spool mounted on said support rod, and a tensioning reel attached to said support rod to maintain the same taut when the bow string is at rest and when fully drawn.

7. A bow adjustment device as defined in claim 6, wherein said at least one line comprises a pair of spaced lines.

8. A bow adjustment device as defined in claim 6, wherein in said means for securing the elongated support plate to the handle comprises a dovetail element mateable with a sight bracket carried by the bow handle.

* * * * *